US010161621B2

(12) United States Patent
Acampora et al.

(10) Patent No.: US 10,161,621 B2
(45) Date of Patent: Dec. 25, 2018

(54) IN-GRADE LIGHT FIXTURE

(71) Applicant: ABL IP Holding LLC, Decatur, GA (US)

(72) Inventors: Kenneth J. Acampora, Northridge, CA (US); Jesus Martinez, Eastvale, CA (US); Guang Jim, Santa Monica, CA (US)

(73) Assignee: ABL IP Holding LLC, Atlanta, GA (US)

( * ) Notice: Subject to any disclaimer, the term of this patent is extended or adjusted under 35 U.S.C. 154(b) by 235 days.

(21) Appl. No.: 14/989,086

(22) Filed: Jan. 6, 2016

(65) Prior Publication Data

US 2016/0377280 A1 Dec. 29, 2016

Related U.S. Application Data

(60) Provisional application No. 62/183,531, filed on Jun. 23, 2015.

(51) Int. Cl.

| | |
|---|---|
| ***F21S 8/02*** | (2006.01) |
| ***F21V 29/77*** | (2015.01) |
| ***F21V 31/00*** | (2006.01) |
| ***F21W 131/10*** | (2006.01) |
| ***F21Y 115/10*** | (2016.01) |

(52) U.S. Cl.

CPC ..... *F21V 31/005* (2013.01); *F21S 8/022* (2013.01); *F21V 29/77* (2015.01); *F21W 2131/10* (2013.01); *F21Y 2115/10* (2016.08)

(58) Field of Classification Search

CPC ..... F21V 31/005; F21V 29/77; F21S 8/022; F21Y 2115/10; F21W 2131/10

See application file for complete search history.

(56) References Cited

U.S. PATENT DOCUMENTS

| | | | | |
|---|---|---|---|---|
| 5,041,950 | A * | 8/1991 | Tyson | F21S 8/022 362/153.1 |
| 5,198,962 | A | 3/1993 | Tyson | |
| 5,276,583 | A | 1/1994 | Tyson | |
| RE34,709 | E | 8/1994 | Tyson | |
| 5,408,397 | A | 4/1995 | Tyson | |
| 5,486,988 | A | 1/1996 | Tyson | |
| 5,727,873 | A | 3/1998 | Tyson | |
| 6,068,384 | A * | 5/2000 | Tyson | F21S 8/022 362/153.1 |
| 7,806,550 | B2 * | 10/2010 | Tyson | F21V 31/005 362/153 |
| 8,313,208 | B2 | 11/2012 | Tyson et al. | |
| 8,789,978 | B2 * | 7/2014 | Tickner | F21S 8/02 362/294 |
| 8,845,134 | B2 * | 9/2014 | Chiba | H01L 33/52 362/249.02 |
| 8,926,145 | B2 * | 1/2015 | Lynch | F21S 8/02 257/98 |
| 2004/0208009 | A1 * | 10/2004 | Mardon | F21K 9/00 362/373 |
| 2009/0027900 | A1 * | 1/2009 | Janos | F21V 21/0824 362/373 |

(Continued)

*Primary Examiner* — Mary Ellen Bowman

(74) *Attorney, Agent, or Firm* — Kilpatrick Townsend & Stockton LLP

(57) ABSTRACT

An in-grade light fixtures having hermetically sealed components that enable water and air to pass through the fixture to effectuate cooling without degrading the fixture components.

22 Claims, 9 Drawing Sheets

(56) References Cited

U.S. PATENT DOCUMENTS

| | | | | |
|---|---|---|---|---|
| 2010/0171405 | A1* | 7/2010 | Chan | F21K 9/00 313/46 |
| 2012/0250297 | A1* | 10/2012 | Higgins | F21V 29/83 362/158 |
| 2017/0082279 | A1* | 3/2017 | Manahan | F21V 31/005 |

* cited by examiner

IN-GRADE LIGHT FIXTURE

RELATED APPLICATIONS

This application claims the benefit of U.S. Provisional Application No. 62/183,531, filed Jun. 23, 2015 and entitled "IN-GRADE LIGHT FIXTURE," the entire contents of which are hereby incorporated by reference.

FIELD OF THE INVENTION

Embodiments of the present invention relate to in-grade light fixtures having hermetically sealed components that enable water and air to pass through the fixture without degrading the fixture components.

BACKGROUND OF THE INVENTION

In-grade light fixtures are installed in the ground such that the top of the fixture is substantially flush with the ground and light is emitted upwardly from the fixture. This installation environment exposes the fixtures to a variety of environmental elements (e.g., water, dirt, sand, mud, etc.) that over time can damage the fixture components and detrimentally impact operation of the fixture. As a result, in-grade light fixtures are typically water-tight to prevent such elements from penetrating into the fixture.

In-grade fixtures are often intended to illuminate specific targets (such as columns, flags, and other architectural structures) or large wide targets (such as facades, trees, walls, signs, etc.). High output LEDs are often used to attain the desired illumination. However, such LEDs generate a great deal of heat during operation. Given that the LEDs are sealed within the fixture, it is difficult to disseminate the heat generated by them. After time, the heat can reduce the useful life of the fixture, thus requiring component replacement or is some cases entire fixture replacement. Replacement of critical components for an in-grade light fixture can require opening critical sealed areas thus subjecting the fixture to future damage due to improper reassembly. In addition, removing and replacing an entire fixture can be both expensive and time consuming.

SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention are directed to in-grade light fixtures having hermetically sealed components such that water and air may flow through the fixture without degrading or detrimentally impacting operation of the light fixture and while enhancing heat dissipation from the fixture.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
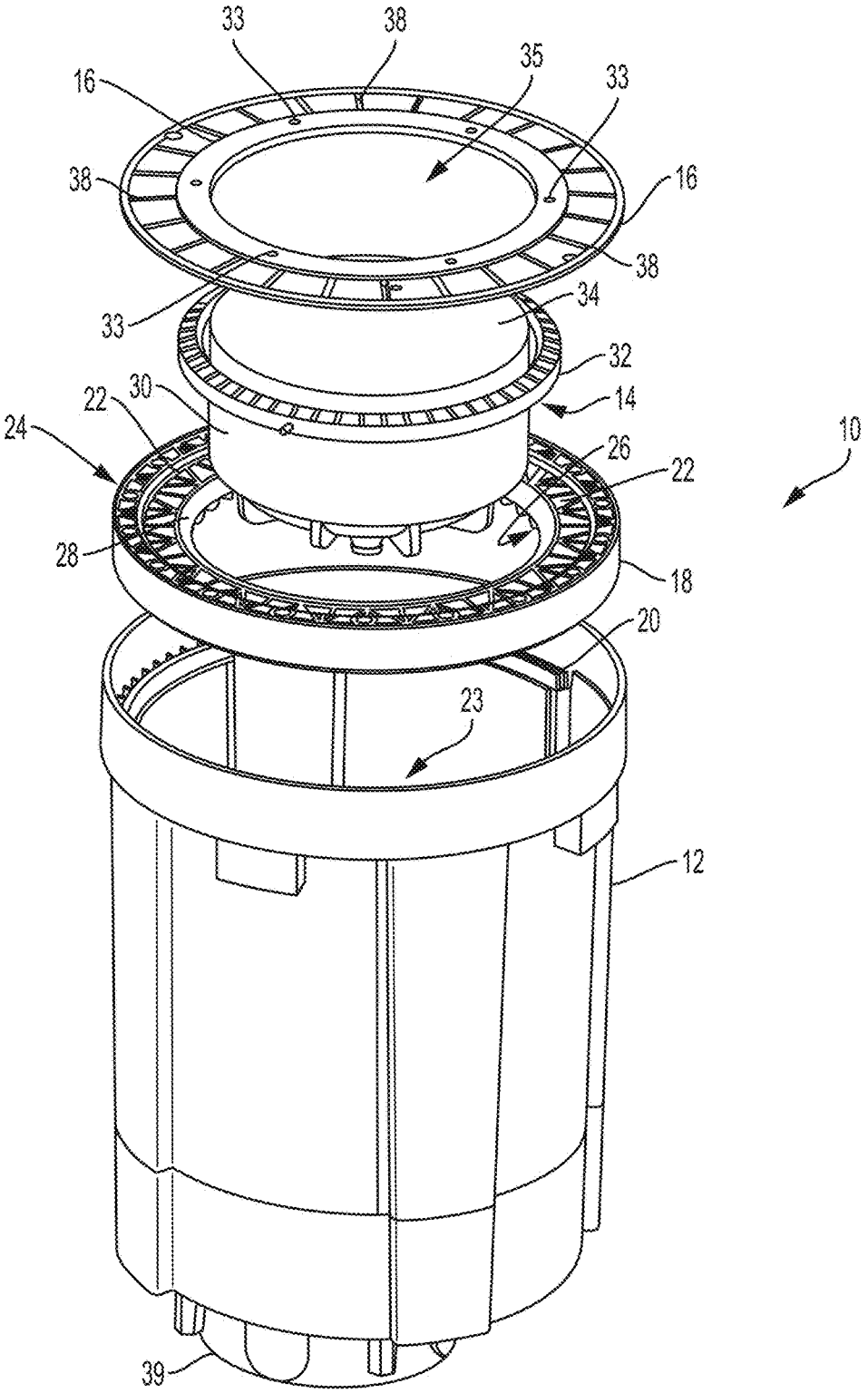
FIG. 1 is a partially exploded view of a light fixture according to one embodiment.

Turning in detail to the figures, an exploded view of one embodiment of a light fixture 10 is illustrated in FIG. 1. The light fixture 10 includes a fixture housing 12, an LED module 14, a finishing piece 16, and a power module 70 (see FIG. 7).

Figure 3:
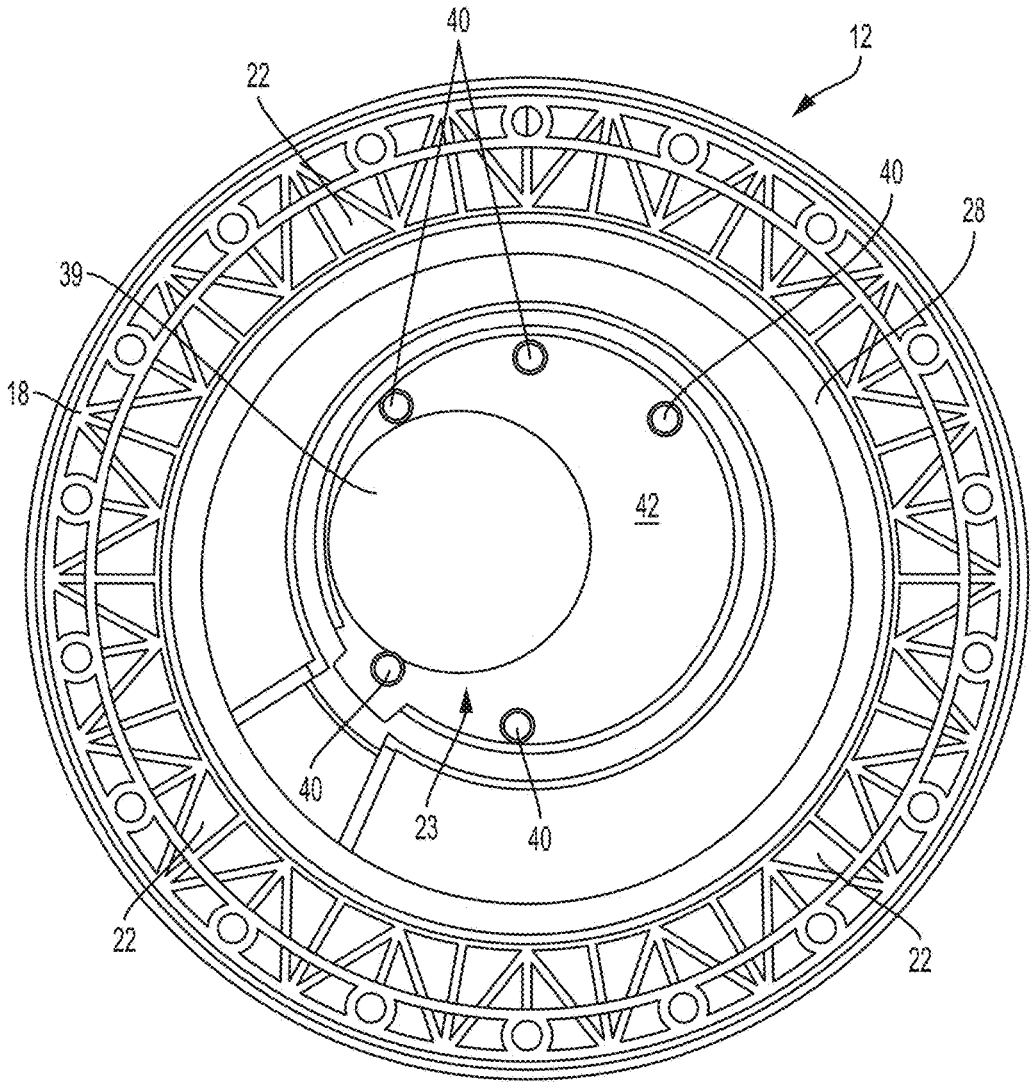
FIG. 3 is a top plan view of the housing of the light fixture of FIG. 1.

The fixture housing 12 houses and/or supports the LED module 14, finishing piece 16, and power module 70. FIG. 3 is a top plan view of the fixture housing 12 (without the LED module 14 or finishing piece 16 positioned thereon) and depicts the substantially hollow cylindrical shape of the fixture housing 12. However, the fixture housing 12 is by no means intended to be limited only to cylindrical shapes; rather, it can be any other shape suitable for housing the various components of the fixture.

The fixture housing 12 may be formed of any material having suitable structural integrity to support these light fixture components. The fixture housing 12 should also be formed of materials that do not degrade, corrode, or otherwise deteriorate in the in-grade environment. In some embodiments, the fixture housing 12 may be formed of metallic or polymeric materials. For example, the fixture housing 12 can be formed from injection molded polymeric material (e.g., polysulfone, PVC, polycarbonate, or other suitable polymeric material).

Figure 2:
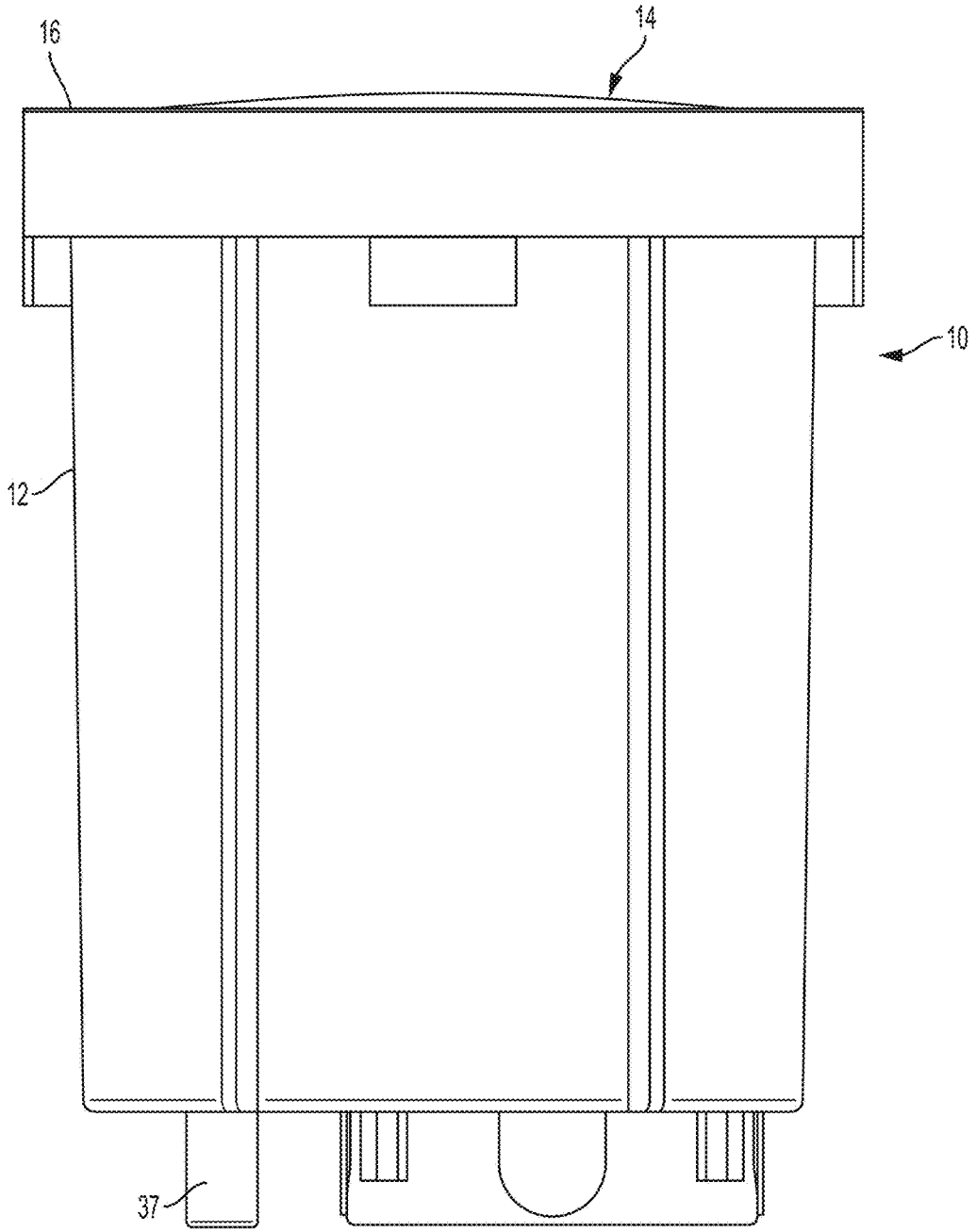
FIG. 2 is a side elevation view of the assembled light fixture of FIG. 1.
Figure 4:
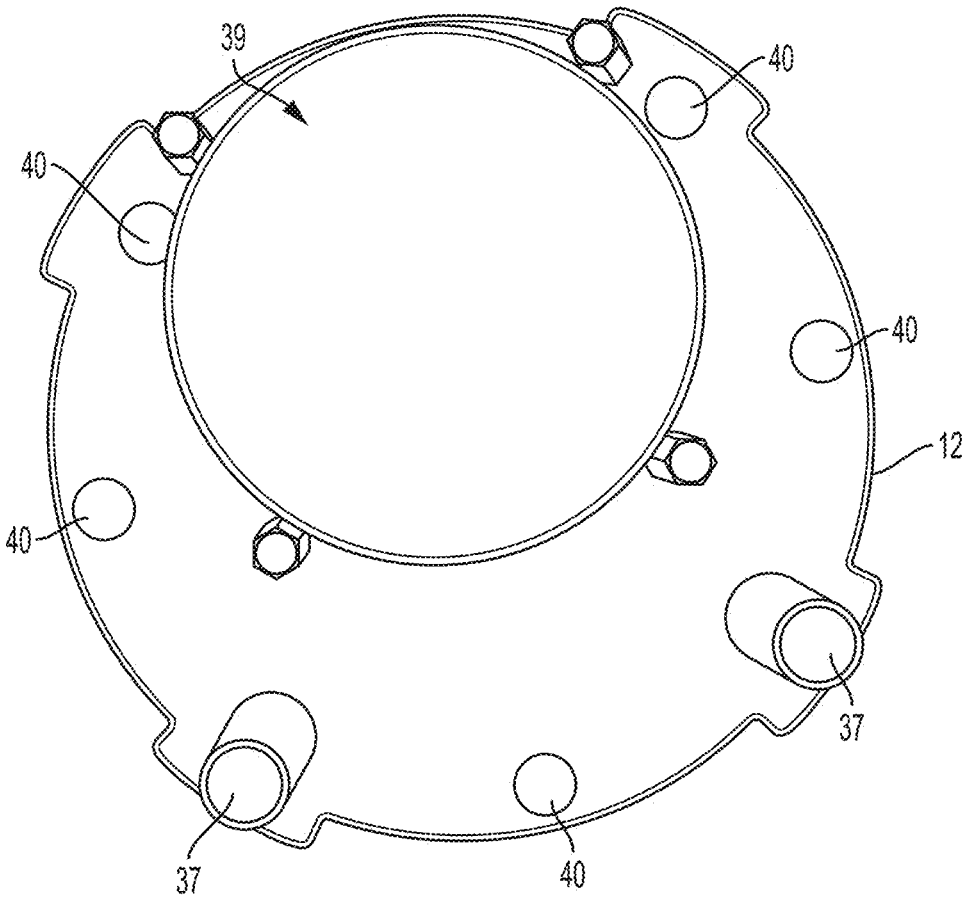
FIG. 4 is bottom plan view of a housing of the light fixture of FIG. 1.

As shown in FIG. 2, a junction box cavity 39 may be integrally formed in the bottom surface 42 of the fixture housing 12. Balancing legs 37 may also be provided to stabilize the light fixture 10 in an upright position. In some embodiments, the junction box cavity 39 can be a separate piece that may be coupled to the fixture housing 12. FIG. 4 shows a bottom view of the fixture housing 12 with the junction box cavity 39. A power cord extending from an external power source can be coupled to a junction box positioned in the junction box cavity 39 via a conduit in the junction box cavity 39. In some embodiments, multiple conduits can be included in the junction box cavity 39 for ease of connection to the external power source. The junction box can be sealed to prevent damage from water and other elements.

The fixture housing 12 can include a support ring 18 that is received in the fixture housing 12 and supported on at least one projection 20 extending from the interior wall 21 of the fixture housing 12. In some embodiments, the support ring 18 is formed integrally with the fixture housing 12. The support ring 18 can include openings 22 that extend from a top surface 24 of the support ring 18 to a bottom surface 26 of the support ring 18. When the support ring 18 is positioned within or formed with the fixture housing 12, the openings 22 are in fluid communication with an interior cavity 23 of the fixture housing 12 such that the openings 22 in the support ring 18 allow air and water to pass through the support ring 18 and enter the interior cavity 23 of the fixture housing 12. The support ring 18 can also include an inner flange 28 for supporting the LED module 14, as described in more detail below.

As been seen in FIGS. 3 and 4, the fixture housing 12 can also include lower openings 40 in the bottom surface 42 of the fixture housing 12. In some embodiments, the lower openings 40 can be positioned in the sidewall of the fixture housing 12. The lower openings 40 are provided to allow water and air to exit from the interior cavity 23 of the fixture housing 12.

Figure 5:
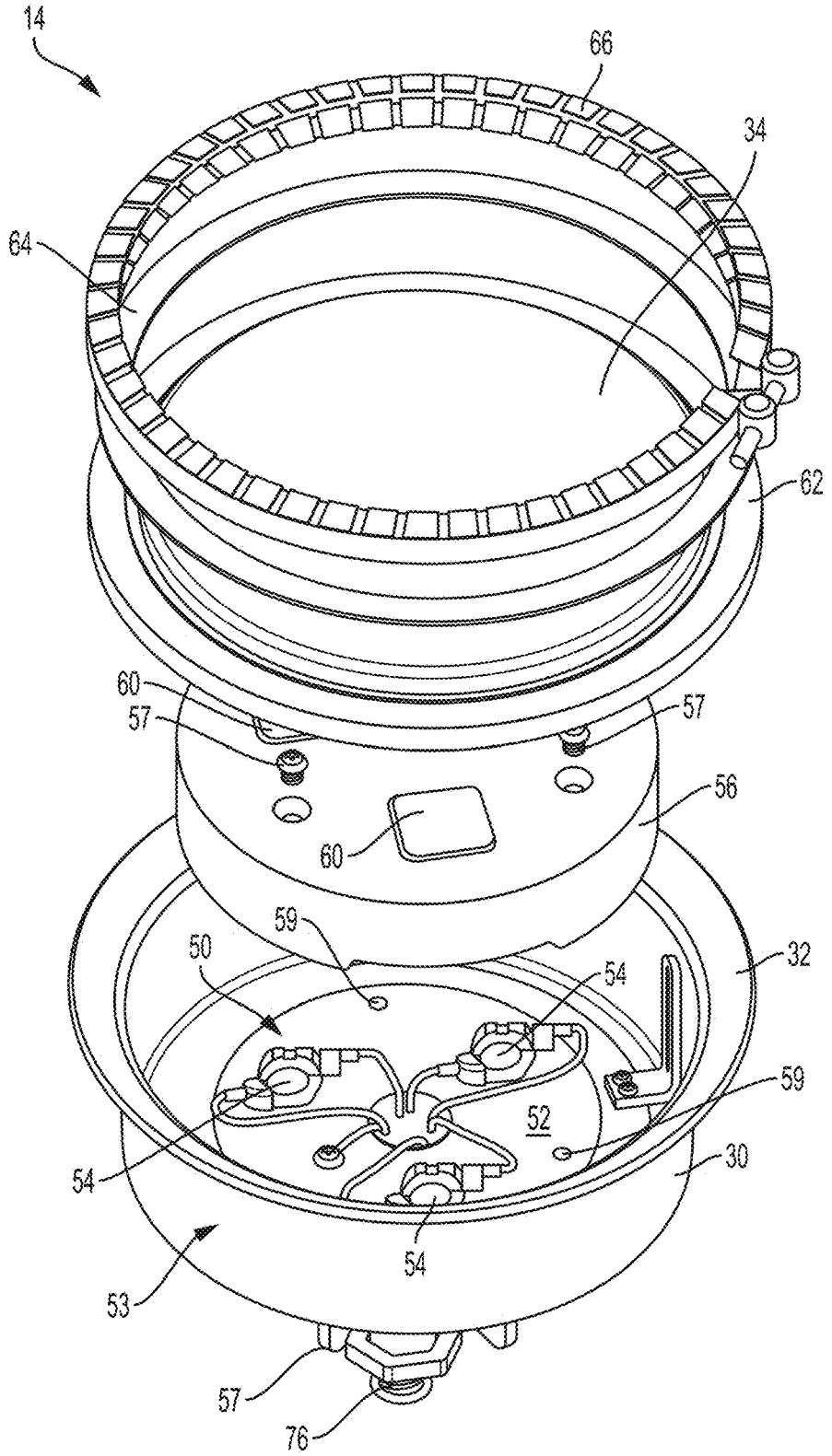
FIG. 5 is an exploded view of an LED module of the light fixture of FIG. 1.
Figure 6:
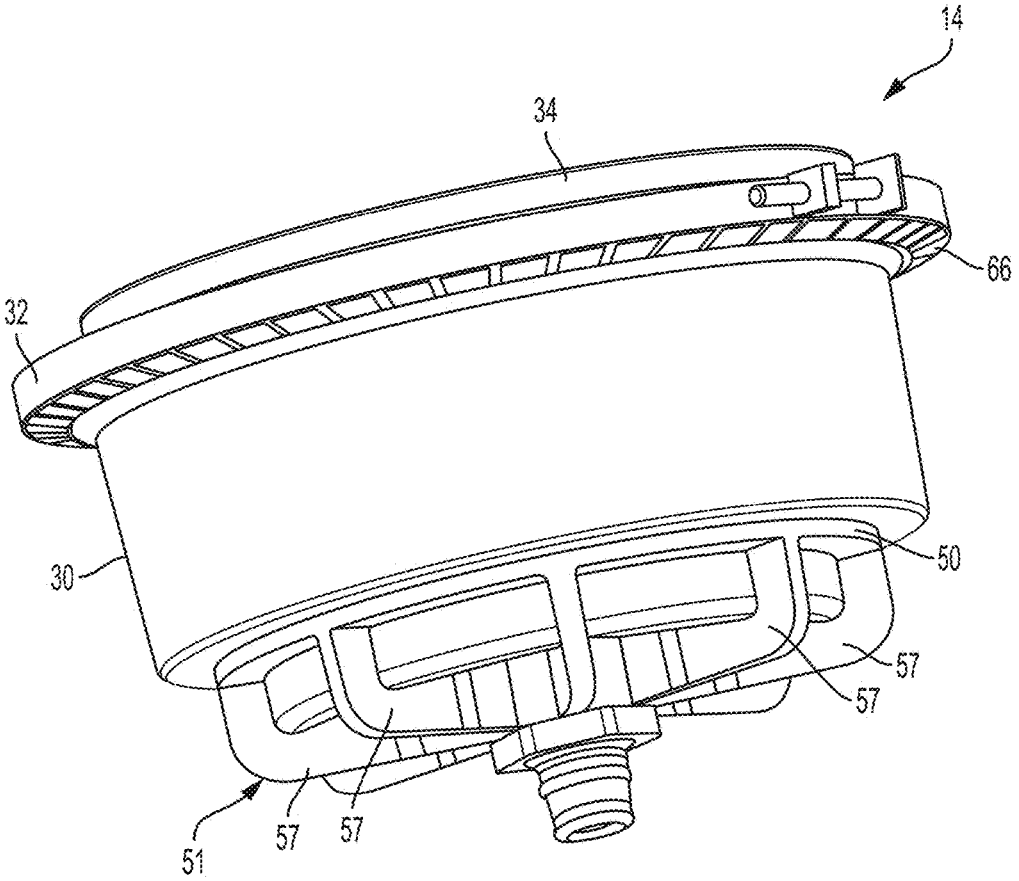
FIG. 6 is a bottom perspective view of the assembled LED module of FIG. 5.

An embodiment of the LED module 14 is shown in FIGS. 5 and 6. The LED module 14 includes a can 30 and heat sink 50 that collectively form an LED module housing 53 for housing the various components of the LED module 14. A lip 32 may be provided in the can 30. The lip 32 of the can 30 can be positioned on the inner flange 28 of the support ring 18 such that the LED module 14 is suspended within the fixture housing 12. However, the LED module 14 may be supported in the fixture housing 12 in other ways.

In some embodiments, the can 30 is a metallic can onto which the heat sink 50 is die cast or fused such that the heat sink 50 forms the base of the LED module housing 53. The heat sink 50 and the can 30 can be die cast or fused such that a hermetic seal is formed between the heat sink 50 and the can 30. The can 30 may be formed of any suitable metallic material, for example stainless steel, brass, bronze, or other suitable metallic material. The heat sink 50 may be formed of any suitable material conducive to casting, for example but not limited to, brass. In some embodiments, the heat sink 50 can be formed of a brass material having high thermal conductivity and high corrosion resistance, such as brass alloy C85800, though other suitable brass material may be used. The heat sink 50 may also be welded to the can 30 or, in some embodiments, may be silver soldered to the can 30 to form the LED module housing 53.

As indicated above, the heat sink 50 forms the base of the LED module housing 53. More specifically, the heat sink 50 is formed to have a mounting surface 52 exposed on the bottom inner surface of the LED module housing 53 and the lower portion 51 that extends from beneath the can 30 (see FIG. 6). The lower portion 51 may be provided with fins 55 to facilitate heat dissipation from the LED module 14. The heat sink 50 may further be formed to have a connector 76 for connecting the LED module 14 to power module 70, as described in more detail below.

LEDs 54 are mounted on the mounting surface 52 of the heat sink 50. LEDs 54 may be provided on printed circuit boards ("PCB") that are subsequently mounted on the mounting surface 52 of the heat sink 50. In some embodiments, the LEDs may be mounted directly onto the mounting surface 52. For example, as shown in FIG. 5 the LEDs 54 may be high output, chip-on-board ("COB") LEDs (e.g., Nichia J Series or equivalents thereof) that mount directly onto the mounting surface 52 of the heat sink 50. COB LEDs may be mounted directly onto the mounting surface 52 without a PCB positioned between the mounting surface 52 and the COB LEDS. The COB LEDs may be, for example, soldered or otherwise affixed directly to the mounting surface 52 and copper tracer may be printed directly onto the mounting surface 52 to electrically interconnect the COB LEDs. The direct attachment of the COB LEDs to the mounting surface 52 can streamline the manufacturing process by avoiding the need to first mount the COB LEDs on a PCB and then subsequently attach the PCB to the mounting surface 52. In addition, direct attachment of the COB LEDs to the mounting surface 52 provides a direct path for dissipation of heat generated by the COB LEDs (and thus improves the transfer of heat from the COB LEDs) and may obviate any need for an intermediate conductive material to be provided between the LEDs 54 and the heat sink 50.

The LED module 14 can also include a reflector assembly 56 that may be positioned within the LED module housing 53 over the LEDs 54. The reflector assembly 56 may be secured within the LED module housing 53 via fasteners, for example screws 57, though other suitable fasteners may be used. The screws 57 can be received in openings 59 in the heat sink 50. The reflector assembly 56 may comprise injection molded plastic, glass, or other suitable materials.

The reflector assembly 56 includes reflectors 60 that align with discrete LEDs 54 when the reflector assembly 56 is positioned within the LED module housing 53. In some embodiments, the reflector assembly 56 may have a single reflective surface that reflects the light emitted by all of the LEDs 54. The reflectors 60 can be rendered highly reflective. For example, in some embodiments, a surface of the reflectors 60 can have a surface reflectivity in the range of about 96% to about 99.5%, inclusive and more preferably in the range of about 98.5%-99%. The reflectors 60 can be comprised of any reflective material known to those of skill in the art as being suitable for reflective optics, including, but not limited to, polished metals (e.g., polished aluminum), MIRO 4, and reflective coatings (e.g., reflective paints).

Figure 8:
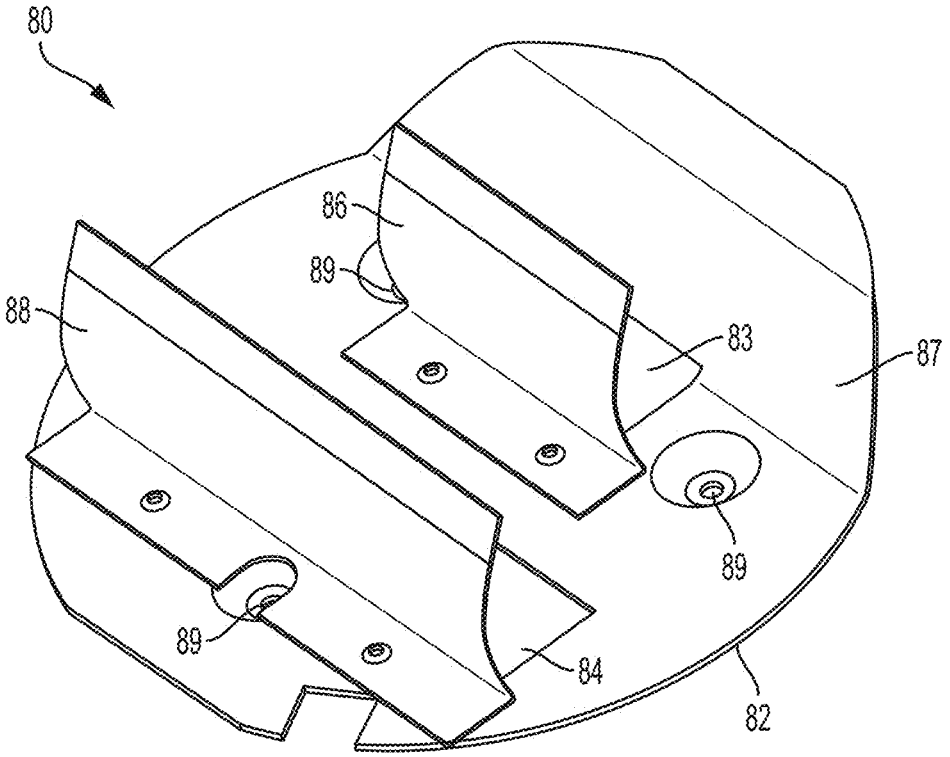
FIG. 8 is a partial perspective view of an alternative embodiment of a reflector assembly for use in the LED module of FIG. 5.

Other embodiments of the reflector assembly 56 are contemplated, including for example the reflector assembly 80 shown in FIG. 8. The reflector assembly 80 can include a base 82 having apertures 83, 84 through which light from the LEDs 54 passes. The base 82 can comprise aluminum or other suitable materials. Upstanding reflectors 86, 88 can be positioned to reflect asymmetrically the light emitted by the LEDs 54 of the LED module 14 that projects through the apertures 83, 84. In this way, the fixture does not provide a uniform distribution pattern but rather emitted light is focused in a desired direction. The upstanding reflectors 86, 88 can be rendered highly reflective. For example the upstanding reflectors 86, 88 can comprise a MIRO 4 finish. In some embodiments, the base 82 of the reflector assembly 80 can have angle upwards at an edge 87. The angle at the edge 87 can create space between the can 30 and the reflector assembly 80 when the reflector assembly 80 is installed on the can 30. The space between the can 30 and the reflector assembly 80 at edge 87 can be a wire-way for connecting wires of the LED module 14. The reflector assembly 80 can be installed on the heat sink 50 via fasteners fed through openings 89 in the base 82.

Figure 9:
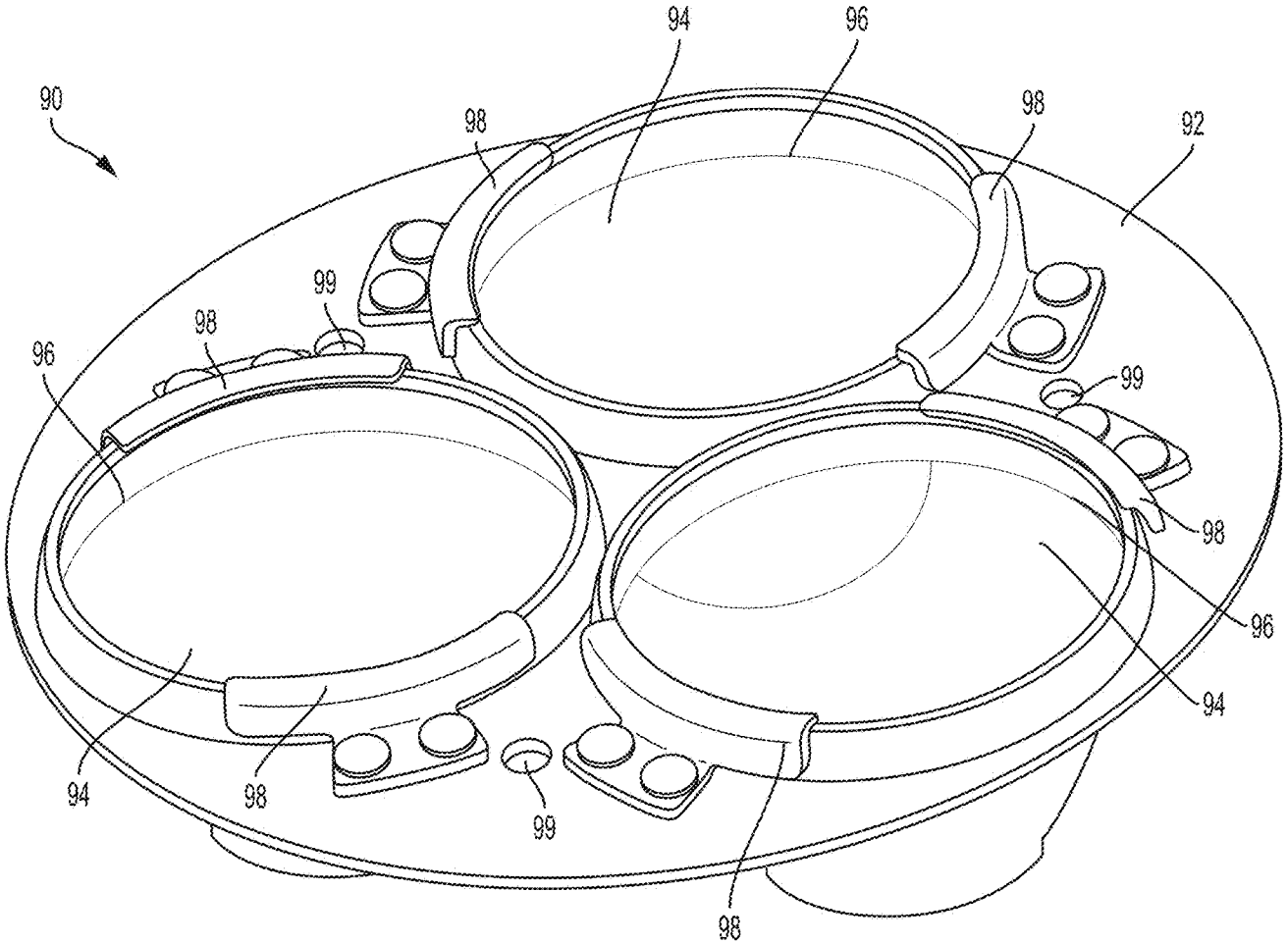
FIG. 9 is a perspective view of an alternative embodiment of a reflector assembly for use in the LED module of FIG. 5.

An additional embodiment of a reflector assembly 90 is shown in FIG. 9. Reflector assembly 90 can include a base 92 and reflector cups 94. The base 92 can comprise aluminum or other suitable materials. The base 92 can include apertures 96 that can receive the reflector cups 94. The reflector cups 94 can be secured to the apertures 96 via retaining clips 98. The apertures 96 and the reflector cups 94 can be positioned over the LEDs 54 of the LED module 14. The reflector cups 94 can comprise metalized glass, or other suitable reflective material. The reflector assembly 90 can be secured to the heat sink 50 via fasteners that pass through openings 99 in the base 92 of the reflector assembly 90.

The LED module 14 can also include a lens 34 positioned and secured over the reflector assembly 56. The lens 34 will be exposed when the fixture is in use and thus should be formed from a material having suitable strength and integrity to withstand the rigors of use (e.g., foot traffic, heat, chemicals, corrosion, etc.). In some embodiments, the lens 34 may be formed of glass or polymeric materials. The lens 34 can be a clear flat lens but may be provided with any optical enhancements to create the desired lighting effect.

A gasket 62 is provided around a perimeter edge of the lens 34 to seal the LED module 14. The LED module 14 may also include a retaining ring 64 and a clamp band 66 for further sealing the lens 34 to the LED module housing 53. During assembly, the lens 34 is positioned on the lip 32 of the can 30. The retaining ring 64 is positioned to lie on the gasket 62 and the clamp band 66 wrapped around the lip of the can 32 (as well as the edges of the lens 34/optional gasket 62) and optional retaining ring 64 so as to sandwich those components between the clamp band 66. The clamp band 66 can be tightened by drawing the ends of the clamp band 66 closer together, for example via a screw. In this way, the clamp band 66 secures the lens 34 together against the lip 32 of the can 30 to hermetically seal the LED module 14. Prior to sealing the LED module 14, it may be desirable to use a "dry air purge" process to eliminate moisture from being trapped within the sealed LED module 14 during assembly and thereby prevent condensation on the internal surface of the lens 34.

The light fixture 10 further includes a finishing piece 16 that is secured onto the fixture housing 12 over the LED module 14 (see FIG. 1). In some embodiments, the finishing piece is screwed onto the support ring 18 of the fixture housing 12 via screws (not shown) and screw apertures 33; however, other mechanical and chemical retention means would certainly be known and contemplated by a person of ordinary skill in the art.

The finishing piece 16 will typically have a shape that generally corresponds to the cross-sectional shape of the fixture housing 12. In this illustrated embodiment, the finishing piece 16 has a generally circular shape. The finishing piece 16 is provided with a central opening 35 for receiving the lens 34 of the LED module 14.

Apertures 38 are provided in the finishing piece 16. The apertures 38 can be in fluid communication with the openings 22 of the support ring 18 such that fluid and gas, for example water and air, can pass through the apertures 38, flow through the openings 22 of the support ring 18, and enter the interior cavity 23 of the fixture housing 12.

Figure 7:
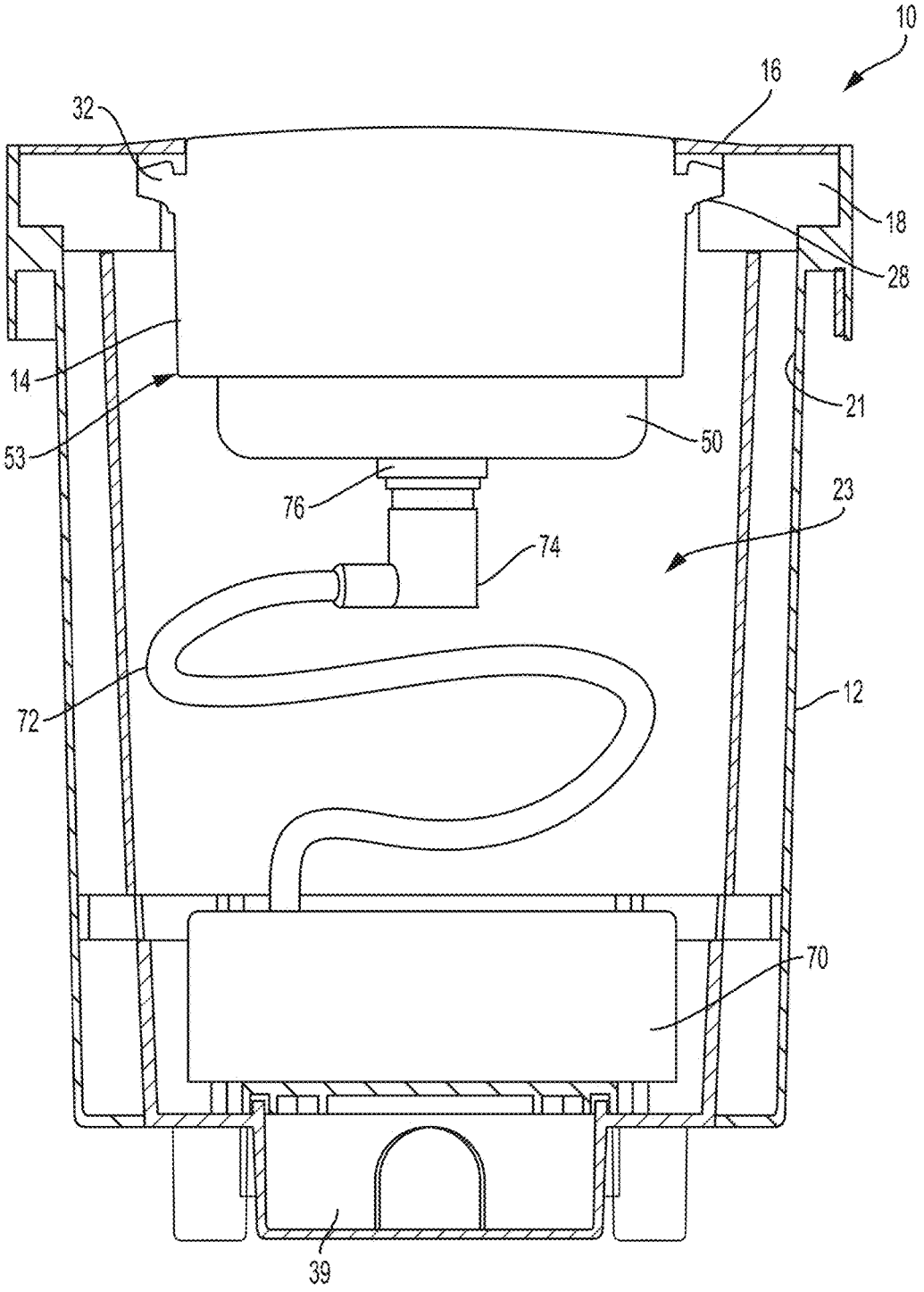
FIG. 7 is a schematic cross-sectional view of the light fixture of FIG. 1

The apertures 38 of the finishing piece 16 can be of any suitable shape, size, and number for providing fluid communication between the apertures 38 and the openings 22 of the support ring 18. For example, as shown in FIG. 1 the apertures 38 are generally slit-shaped, though other suitable shapes can be used. The finishing piece 16 may be formed of any materials suitable for this application, including but not limited to metallic and polymeric materials. FIG. 7 shows a schematic cross-sectional side view of one embodiment of an assembled light fixture 10. The power module 70 is positioned within the interior cavity 23 of the fixture housing 12 proximate to a bottom surface 42 of the fixture housing 12. The power module 70 can be hermetically sealed in epoxy. The LED module 14 is supported within the housing by engagement of lip 32 of the LED module 14 with inner flange 28 of support ring 18. The LED module 14 is coupled to the power module 70. A first cable 72 can extend between the LED driver within the power module 70 and the LED module 14. The first cable 72 can be water tight and can include a plug 74 that can engage the connector 76 provided on the lower portion 51 of the heat sink 50. The plug 74 can be custom molded and can be water-tight. The connector 76 can also be custom-molded and water-tight. The engagement of the plug 74 and connector 76 can provide a water tight connection between the plug 74 and connector 76. The plug 74 and the connector 76 can be easily connected and disconnected. The ease of connection between these two features can allow for easy replacement and/or maintenance of the LED module 14 without having to remove the entire light fixture 10 from an installation. Rather, the finishing piece 16 can be removed from the fixture housing 12 and the LED module 14 and/or power module 70 easily removed and replaced by simple disconnection from and reconnection with each other. A second cable (not shown) can also extend between the power module 70 and a junction box positioned in the junction box cavity 39 of the fixture housing 12. In some embodiments, the second cable can be connected to a junction box that is housed separately from the fixture housing 12. The second cable can be a water-tight cable.

After the LED module 14 has been positioned in the fixture housing 12, the finishing piece 16 is then secured onto the fixture housing 12 and over the LED module 14. When so secured, the apertures 38 of the finishing piece 16 at least partially align with the openings 22 in the support ring 18 to permit air and water to enter the fixture housing 12, pass through the interior 23 of the fixture housing 12, and exit the fixture housing 12 via the lower openings 40 in the fixture housing 12. In use, air and water can pass through the apertures 38 in the finishing piece 16 and the openings 22 in the support ring 18 to enter the interior of the fixture housing 12. The lower portion 51 of the heat sink 50 is exposed to such air and water such that the heat from the LEDs 54 that has been conducted to the heat sink 50 is convectively dissipated from the heat sink 50 by the air and water moving through the fixture housing 12. The water and air may then exit the fixture housing 12 via lower openings 40. The exposure of the heat sink 50 to the air and water that may pass through the fixture housing 12 can enhance the convective and conductive cooling of the heat sink 50. The enhanced convective and conductive cooling of the heat sink 50 can enable the use of higher output LEDs in the LED module 14 while continuing to effectively manage and dissipate the increased heat associated with higher output LEDs. Because the LED module 14 and the power module 70 are each hermetically sealed, their operation is not compromised by water passing through the fixture housing 12 of the light fixture 10. Moreover, such movement of water and air through the fixture housing 12 helps to flush particulates and contaminants (sand, dirt, mud, etc.) that may have accumulated within the fixture housing 12.

Thus, an improved in-grade light fixture is disclosed. While embodiments and applications of this invention have been shown and described, it would be apparent to those skilled in the art that many more modifications are possible without departing from the inventive concepts herein. The invention, therefore, is not to be restricted except in the spirit of the claims. Rather, different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

The invention claimed is:

1. A light fixture suitable for installation outdoors and in the ground, the light fixture comprising:

an LED module comprising an LED module housing formed by a can and a heat sink, wherein the heat sink comprises a brass material and wherein the heat sink is cast onto the can for hermetically sealing the heat sink to the can, the heat sink comprising a mounting surface exposed within the LED module housing and an external portion that extends exterior to the can, wherein the can comprises a first material that is different from the brass material of the heat sink; and a plurality of LEDs positioned on the mounting surface of the heat sink.

2. The light fixture of claim 1, wherein the LED module further comprises a reflector assembly positioned above the plurality of LEDs.

3. The light fixture of claim 2, wherein the reflector assembly comprises a plurality of apertures through which light emitted by the plurality of LEDs may pass.

4. The light fixture of claim 2, wherein the LED module further comprises a lens positioned over the reflector assembly and hermetically sealed onto the LED module housing to render the LED module impermeable to air and water.

5. The light fixture of claim 1, further comprising:

a fixture housing defining an interior cavity and having at least one projection that extends into the interior cavity; and a support ring supported on the fixture housing by the at least one projection, wherein the support ring comprises a flange that supports the LED module within the fixture housing and openings that extend entirely through the support ring so as to be in fluid communication with the interior cavity of the fixture housing.

6. The light fixture of claim 5, further comprising:

a power module hermetically sealed within the fixture housing and connected to the LED module.

7. The light fixture of claim 6, wherein a connector is provided on the external portion of the heat sink and wherein the light fixture further comprises a cable that extends from the power module and that comprises a plug positioned on an end of the cable for engaging the connector on the heat sink so as to connect the LED module to the power module.

8. The light fixture of claim 5, wherein the fixture housing further comprises apertures that extend through the fixture housing so as to be in fluid communication with the interior cavity of the fixture housing such that air and water can pass through the openings in the support ring and into the interior cavity of the fixture housing and exit the interior cavity of the fixture housing via the apertures in the fixture housing.

9. The light fixture of claim 5, further comprising a finishing piece mounted on the fixture housing over the support ring and comprising at least one aperture extending through the finishing piece and in fluid communication with the interior cavity of the fixture housing.

10. A method of forming a light fixture suitable for installation outdoors and in the ground, the method comprising:

providing a can comprising a first material;

casting a brass material onto the can to form a heat sink and for hermetically sealing the heat sink to the can such that the heat sink forms a mounting surface in an interior region of the can, wherein the can and heat sink form an LED module housing; and mounting a plurality of LEDs on the mounting surface wherein the first material of the can is different from the brass material of the heat sink.

11. The method of forming the light fixture of claim 10, wherein mounting the plurality of LEDs on the mounting surface comprises mounting the plurality of LEDs directly on the mounting surface without a printed circuit board interposed between the LEDs and the mounting surface so as to provide a direct path for dissipation of heat generated by the plurality of LEDs.

12. The method of forming the light fixture of claim 10, further comprising positioning a reflector assembly above the mounting surface, the reflector assembly including a plurality of apertures through which light emitted by the plurality of LEDs may pass.

13. The method of forming the light fixture of claim 12, further comprising hermetically sealing a lens onto the LED module housing, over the reflector assembly, to prevent air and water from entering the interior region of the can of the LED module housing.

14. The method of forming the light fixture of claim 10, further comprising: molding a custom plug to engage with a connector on a lower portion of the heat sink.

15. A light fixture suitable for installation outdoors and in the ground, the light fixture comprising:

a fixture housing comprising openings that extend through the fixture housing so as to be in fluid communication with an interior cavity of the fixture housing;

an LED module housing positioned within the interior cavity of the fixture housing, the LED module housing comprising a can comprising a first material and a heat sink comprising a brass material, the heat sink being cast onto the can for hermetically sealing the heat sink to the can, the heat sink further comprising a mounting surface exposed within the LED module housing and an external portion that extends exterior to the can, wherein the first material of the can is different from the brass material of the heat sink; and a plurality of LEDs positioned on the mounting surface.

16. The light fixture of claim 15 further comprising a power module positioned within the fixture housing, the power module being hermetically sealed to render the power module impermeable to air and water.

17. The light fixture of claim 16 further comprising a cord extending between the power module and a connector on an outer surface of the heat sink, the cord including a custom molded plug for engaging with the connector.

18. The light fixture of claim 15 further comprising a lens hermetically sealed onto the LED module housing to render the LED module impermeable to air and water.

19. The light fixture of claim 16, further comprising a hermetically sealed junction box positioned within a junction box cavity in the fixture housing, wherein a cord extends between the hermetically sealed junction box and the power module.

20. The light fixture of claim 1, wherein the first material is a stainless steel material.

21. The method of forming the light fixture of claim 10, wherein the first material is a stainless steel material.

22. The light fixture of claim 15, wherein the first material is a stainless steel material.

* * * * *